US007222987B2

(12) United States Patent
Tseng

(10) Patent No.: US 7,222,987 B2
(45) Date of Patent: May 29, 2007

(54) CONNECTOR FOR CONNECTING LIGHT STRINGS

(76) Inventor: Wei-Jen Tseng, 5F, No. 10, Lane 23, Tungshan St., Hsinchu (TW)

( * ) Notice: Subject to any disclaimer, the term of this patent is extended or adjusted under 35 U.S.C. 154(b) by 151 days.

(21) Appl. No.: 11/128,671

(22) Filed: May 13, 2005

(65) Prior Publication Data

US 2006/0258222 A1 Nov. 16, 2006

(51) Int. Cl.
*F21S 4/00* (2006.01)

(52) U.S. Cl. ..... 362/219; 362/654; 362/657; 439/619; 439/356

(58) Field of Classification Search ..... 362/219, 362/654–658; 439/619, 356, 660
See application file for complete search history.

(56) References Cited

U.S. PATENT DOCUMENTS 6,113,430 A * 9/2000 Wu ..... 439/619
6,217,191 B1 * 4/2001 Wu et al. ..... 362/249
6,361,368 B1 * 3/2002 Tseng ..... 439/619
6,774,549 B2 * 8/2004 Tsai et al. ..... 313/318.01
2004/0198088 A1 * 10/2004 Shieh ..... 439/342

* cited by examiner

*Primary Examiner*—Renee Luebke
*Assistant Examiner*—Jessica McMillan
(74) *Attorney, Agent, or Firm*—Alan D. Kamrath; Nikolai & Mersereau, P.A.

(57) ABSTRACT

A connector for connecting a plurality of light strings mainly includes a female socket and a male socket with a plurality of terminal receivers and conductive pieces respectively. The terminal receivers and the conductive pieces are connected with the light-string conducting wires or the control lines of the light strings. Thereby when the male/female sockets are joined together, the light string can be extended or a working module controller for the light string can control more light-strings. The female socket includes a waterproof stopper inside to stabilize the conducting wires going through the female socket and also to provide a waterproof function. A joint nut is set outside of the male socket to reciprocally join with the female socket, so that the male/female sockets will not separate from each other arbitrarily.

20 Claims, 8 Drawing Sheets

CONNECTOR FOR CONNECTING LIGHT STRINGS

BACKGROUND OF THE INVENTION

1. Field of the Invention

The invention relates in general to a connector for connecting a plurality of light strings, and more particularly to a connection device of an application to extend a length by combining the plurality of light strings.

2. Description of the Related Art

Conventional Christmas light strings play an important role nowadays thanks to the help of commercial activities. The light strings are also very popular for decoration on street trees or for special occasions, such as recreation, restaurants, costume and accessories stores, tourism, shopping malls and gift shops. Thereby a demand to extend the light strings is increasing, so as to create a variety of beautiful light effects. However, the more light strings are connected together, the higher demand for a connecting device to provide a secure joint with safe, stable electricity supply.

SUMMARY OF THE INVENTION

It is therefore an objective of the present invention to provide a connector for connecting a plurality of light strings or control lines. The connector can achieve a secure joint effect and a safe, stable electricity supply for the connected light strings or the control lines.

To achieve the above-mentioned objective, a principle technique is applied by providing a connector mainly including a female socket, a male socket, and a joint nut.

The female socket forms a cannular shape having a plurality of terminal receivers on an internal wall for receiving a plurality of electric terminals respectively. An aperture is formed on a bottom for a plurality of paired light-string conducting wires or control lines to go through.

The male socket forms a cylindrical shape with an end forming a cylindrical plug part. An outside diameter of the plug part matches an inside diameter of the female socket to plug in. A plurality of axial holes are formed for a plurality of paired light-string conducting wires or control lines to go through. A conductive piece is set at an aperture periphery of an end of the plug part corresponding to each of the holes. An end of the conductive piece bends to a surface of the plug part, while the other end is connected to the conducting wires or the control lines inside the male socket. The conductive pieces correspond to the electric terminals on the internal wall of the female socket.

The joint nut is set outside the male socket and is connectable with the female socket. Thereby the joint nut can restrict the male socket located between the joint nut and the female socket, so that the male/female sockets will not separate unintentionally.

DETAILED DESCRIPTION OF THE INVENTION

Figure 1:
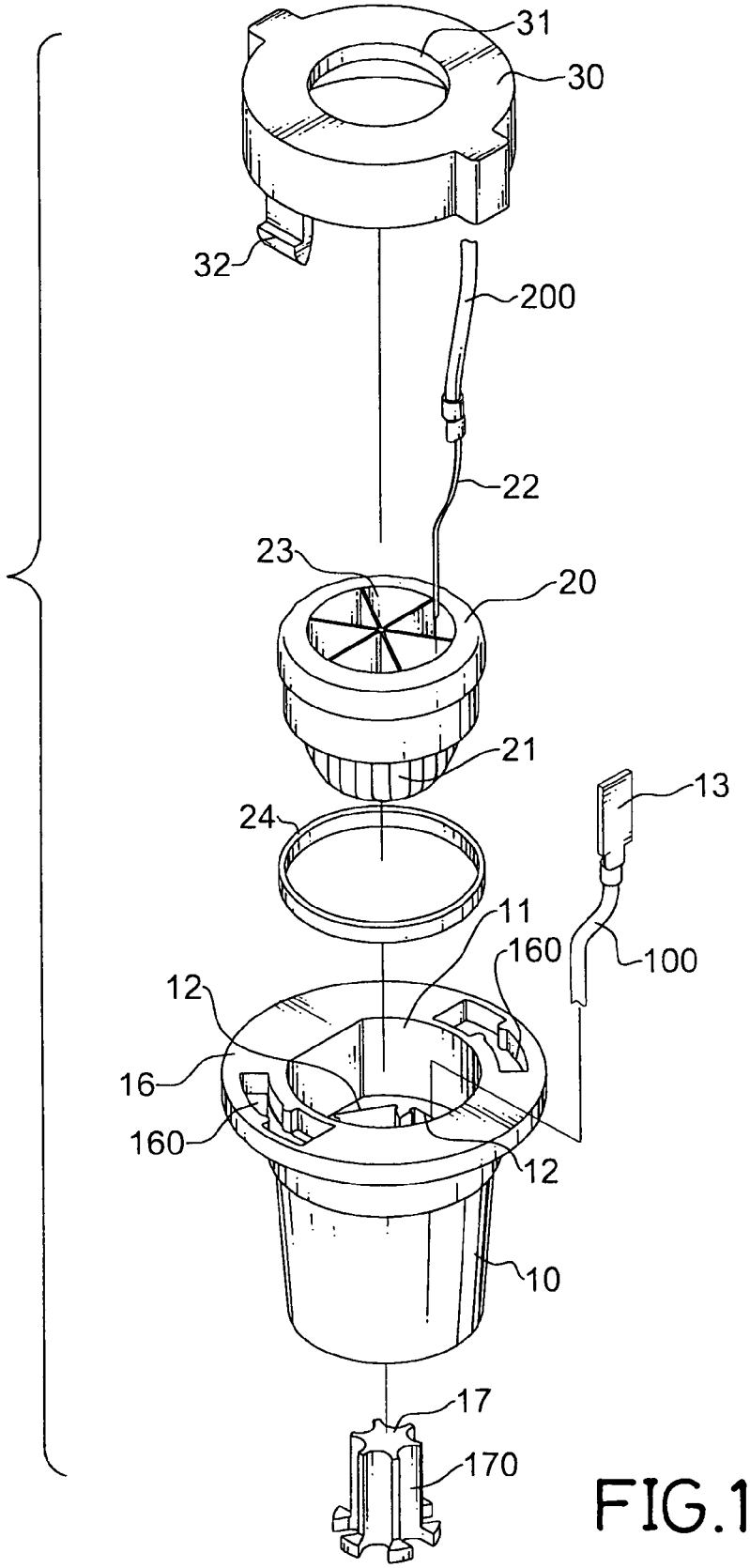
FIG. 1 shows an exploded perspective view of an example of a first preferred embodiment of the present invention.
Figure 2:
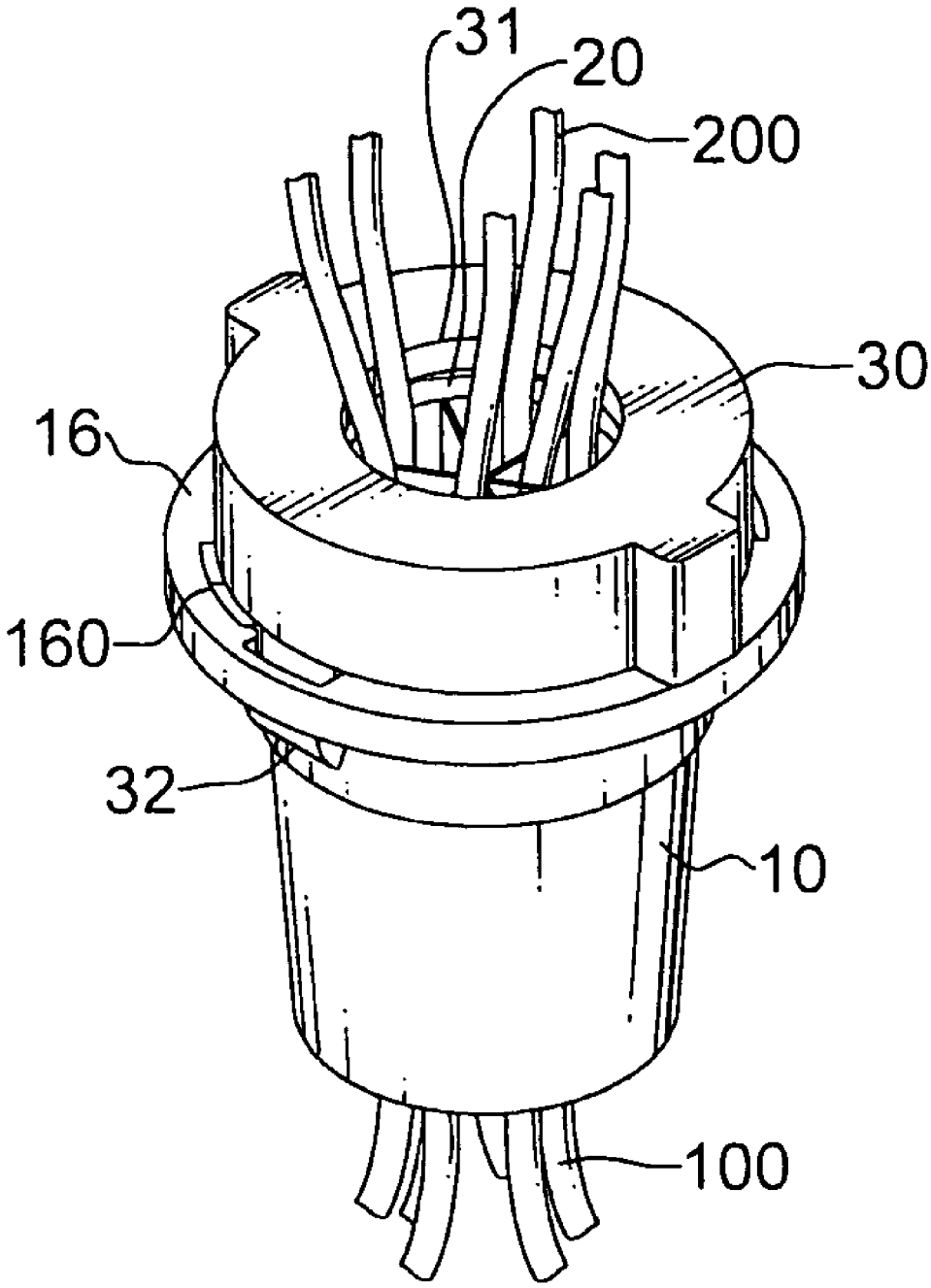
FIG. 2 shows a perspective view of a first preferred embodiment of the present invention.

With reference to FIG. 1, a connector in accordance with the present invention comprises a female socket 10, a male socket 20 and a joint nut 30. The male socket 20 can plug in the female socket 10. The joint nut 30 is to restrict the female/male sockets 10/20 to joint tightly. Referring to FIG. 2, the male socket 20 and the female socket 10 are connected with a plurality of light-string conducting wires or control lines 200 and 100 respectively. The two sets of conducting wires 200 and 100 can be connected to each other via the male/female sockets 20/10. Thereby extending a length of the light-string conducting wires or control lines is achieved. An embodiment of the connector will be described in detail as follows.

Still referring to FIG. 1, the female socket 10 forms a cannular shape with a chamber 11 inside. Multiple symmetrical arranged terminal receivers 12 are formed on an internal wall of the chamber 11 for receiving multiple electric terminals 13 respectively. The electric terminals 13 are connected with the conducting wires 100 respectively. In this example of the preferred embodiment, the female socket 10 has three sets of the paired conducting wires 100. The male socket 20 is also has three sets of the paired conducting wires 200.

Figure 3:
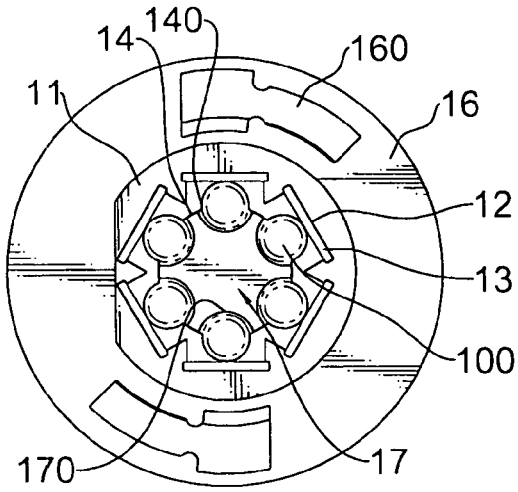
FIG. 3 shows a top view of a female socket of a first preferred embodiment of the present invention.

Referring to FIG. 3, an aperture 14 is formed at a bottom of the female socket 10 for the conducting wires 100 to extend therethrough. A plurality of trenches 140 are formed on an aperture periphery. The trenches 140 correspond to the terminal receivers 12. Ends of the conducting wires 100, which are respectively connected to the electric terminals 13, are correspondingly located inside the trenches 140.

Furthermore, in order to mate the female socket 10 with the joint nut 30, a top of the female socket 10 forms a flange 16. Two slots 160 are formed at two opposed locations of the flange 16. Each slot 160 has one end wider than the other end of the slot 160.

The female socket 10 further includes a waterproof stopper 17 inside a bottom of the chamber 11. The waterproof stopper 17 can be put inside the female socket 10 from a top or from a bottom. The waterproof stopper 17 forms a shaft shape with a profile forming a plurality of internal channels 170. The internal channels 170 correspond to the trenches 140 on the periphery of the aperture 14 of the female socket 10. Thereby each of the conducting wires 100 is confined within the periphery of the aperture 14 and the waterproof stopper 17.

Furthermore, referring to FIG. 1, the male socket 20 forms a cylindrical shape. An outside diameter of one end of the male socket 20 is larger than an inside diameter of the chamber 11 of the female socket 10, and the other end forms a cylindrical shaped plug part 21. An outside diameter of the plug part 21 is nominally smaller than the inside diameter of the chamber 11 of the female socket 10, so as to snugly mate with the female socket 10. A plurality of axial sector holes 23 are formed in the male socket 20 for the plurality of conducting wires 200 to extend therethrough. A conductive piece 22 is set at an aperture periphery of an end of the plug part 21, and corresponds to each of the holes 23. An end of the conductive piece 22 bends to an external wall of the plug part 21, while the other end is connected to the conducting wires 200 inside the male socket 20. The conductive pieces 22 correspond to the electric terminals 13 on the internal wall of the chamber 11 of the female socket 10. A collar 24 mounts on a top of the plug part 21 of the male socket 20. The collar 24 can hold the conductive pieces 22 to an end of the plug part 21, so as to stabilize the conductive pieces 22 as shown in FIG. 4.

Figure 4:
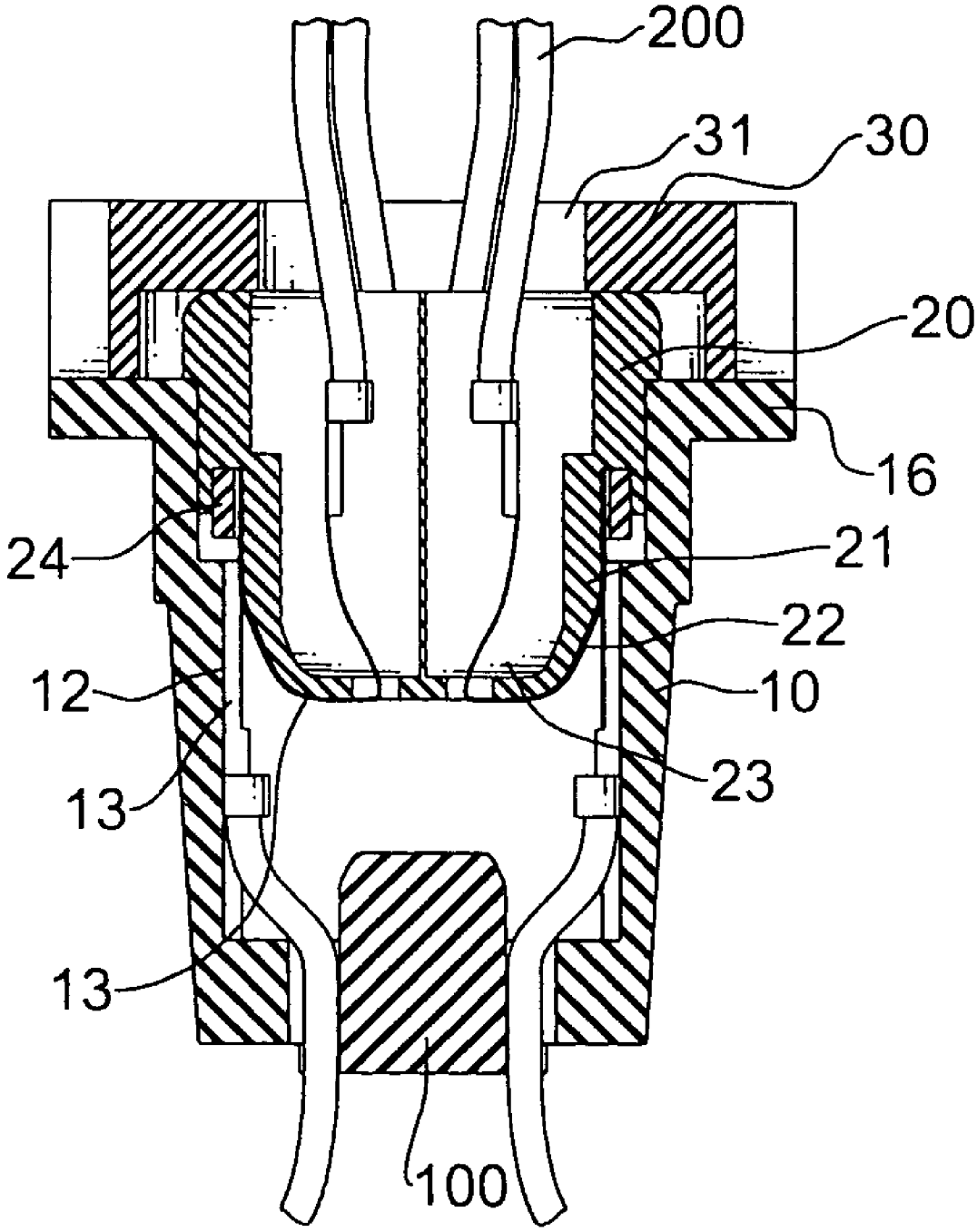
FIG. 4 shows a vertical cross-section diagram of a first preferred embodiment of the present invention.

Still referring to FIG. 4, when the male socket 20 plugs into the chamber 11 of the female socket 10, the conductive pieces 22 inside the plug part 21 of the male socket 20 can electrically connect to the electric terminals 13 inside the chamber 11 of the female socket 10. Thereby a pair of the light-string conducting wires or control lines 100 and 200 can be electrically connected. The male/female sockets 20/10 include several sets of the paired conducting wires 200/100 accordingly. In order to manage the wires easily and avoid mis-connection, the plug part 21 of the male socket 20 and the inner wall of the chamber 11 of the female socket 10 form a tangent plane respectively. Thereby an angle of the male socket 20 plugging into the female socket 10 can be confined to avoid mis-connection error.

Figure 6:
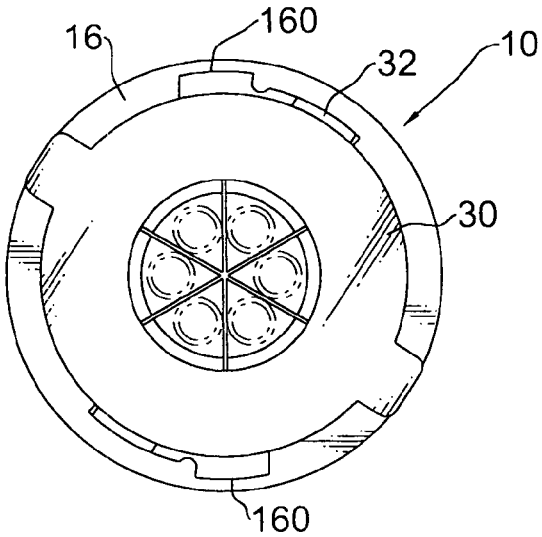
FIG. 6 shows a first preferred embodiment of the present invention.
Figure 5:
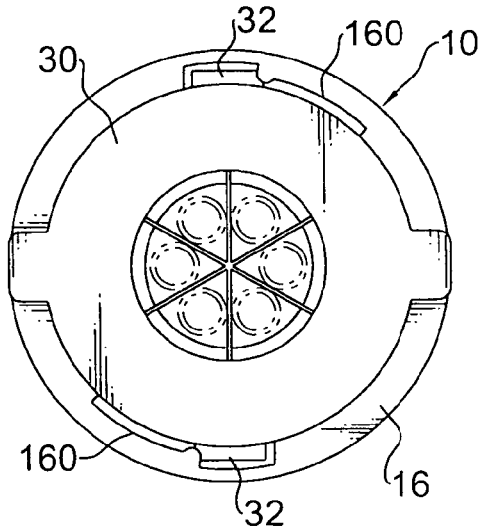
FIG. 5 shows a first preferred embodiment of the present invention.

Referring to FIG. 1, the joint nut 30 is set outside the male socket 20 and mounts the female socket 10. The joint nut 30 forms a hole 31 for the conducting wires 200 to extend therethrough. A bore diameter of the hole 31 is smaller than the outside diameter of the male socket 20, so as to limit the male socket 20 to locate inside the joint nut 30. In this preferred embodiment, the joint nut 30 includes two tenons 32 extending downward respectively at two opposite joint nut peripheries. Each tenon joint 32 corresponds to the respective slot 160. Each tenon joint 32 is dimensioned so as to be insertable into the wider end of the slot 160 as shown in FIG. 5. By rotating the joint nut 30 to an appropriate angle as shown in FIG. 6, the tenon joint 32 moves to the narrower end of the slot 160 as shown in FIG. 6. Thereby the tenon joint 32 is confined in the narrower end of the slot 160, so as to combine the joint nut 30 with the female socket 10. Then the male socket 20 is further confined between the joint nut 30 and female socket 10 as shown in FIG. 4. In this way, the male socket 20 and the female socket 10 will not separate unintentionally.

The embodiment structure and connections between each of the components of the present invention are clearly stated from to the above description. Furthermore, an application method of the present invention is described as follows.

Figure 7:
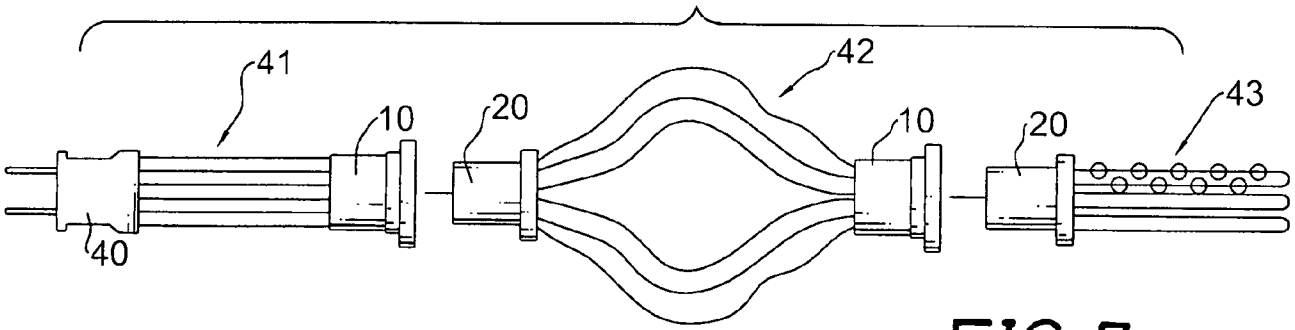
FIG. 7 shows a first operational view of a first preferred embodiment of the present invention.

Referring to FIG. 7, three sets of light strings 41, 42 and 43 are connected by the male sockets 20 and the female sockets 10 of the present invention. A first end of the first set of the light strings 41 is formed as a connector plug 40 to receive electricity directly or indirectly from a supply.

Since the male sockets 20 and the female sockets 10 include three sets of the paired conductive pieces 22 and the electric terminals 13 according to the present invention, each of the three sets of the light strings 41, 42 and 43 includes three sets of positive and negative circuits respectively. Thereby various changes of the light strings can be practically applied. Variety can be achieved by adding or reducing the quantity of the connected light strings such as two sets, four sets, five sets or even more.

Figure 8:
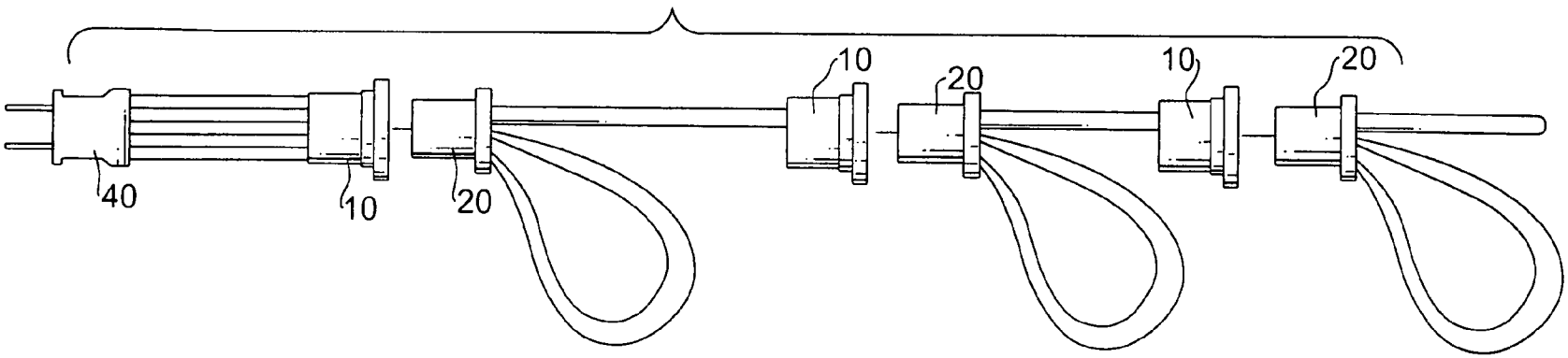
FIG. 8 shows a second operational view of a first preferred embodiment of the present invention.

Although the previous embodiment example in FIG. 7 includes the male sockets 20 and the female sockets 10 forming a plurality of electrical connectors, not all of the connectors need be used simultaneously. Referring to FIG. 8, the male/female sockets 20/10 are also used to form a single connector for each set of male/female sockets 20/10.

In addition, the preferred embodiment of the present invention not only can transmit electric power, but also can transmit a control signal to expand the quantity of the light strings that are controlled by a controller. By replacing the connector plug with the controller, the control signal can be sent to every light string via the male/female sockets 20/10.

Figure 9:
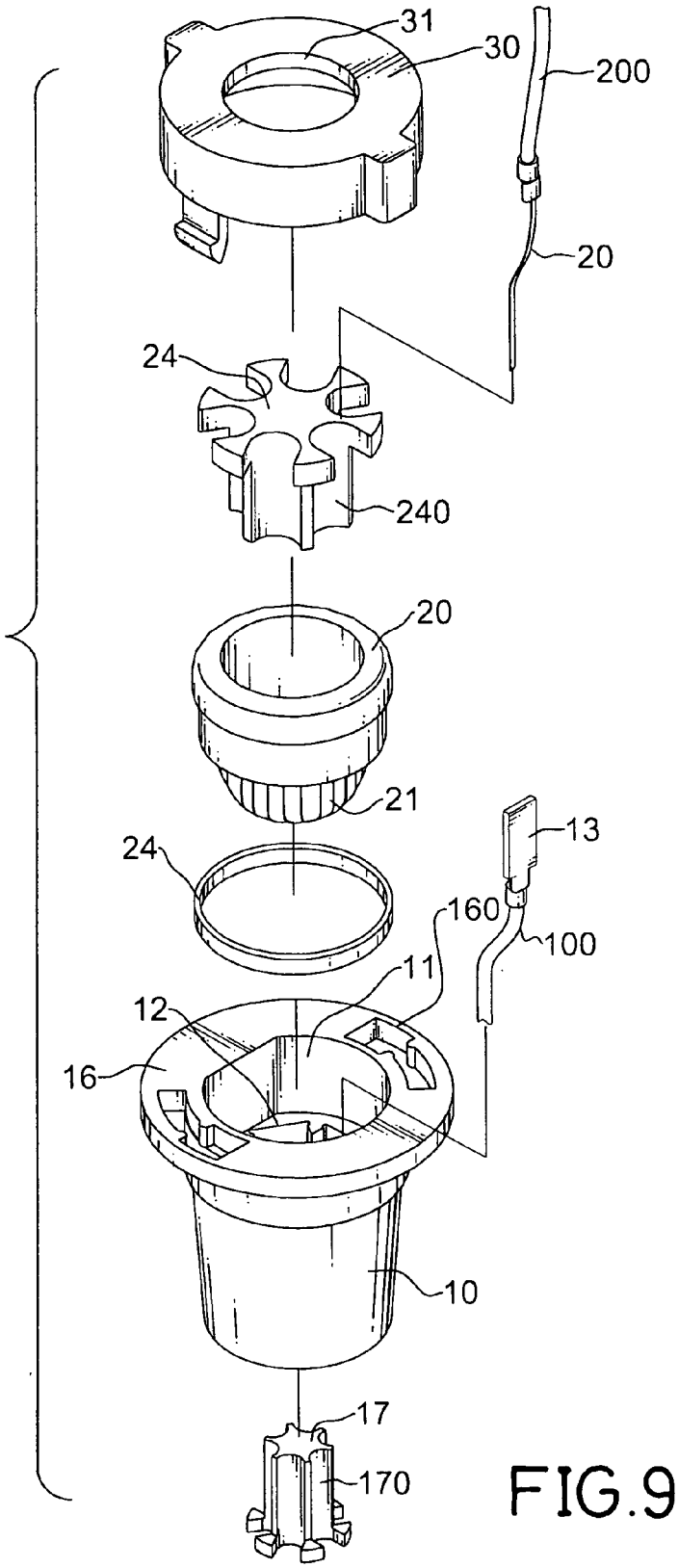
FIG. 9 shows an exploded perspective view of a second preferred embodiment of the present invention.

Referring to FIG. 9, a second preferred embodiment of the present invention is shown. A basic structure is similar to the first preferred embodiment, yet structures of the holes 23 are different. The second preferred embodiment includes the male socket 20 forming a hollow shape with a plurality of holes 23 in the bottom, however the male socket 20 of the second preferred embodiment does not have any partition. Moreover, a stopper 24 can be set inside the male socket 20 as shown in FIG. 9. The structure of the stopper 24 of the second embodiment is similar to the waterproof stopper 17 of the first embodiment; that is the stopper 24 also forms a plurality of trenches 240 on a column body of the stopper 24. When the stopper 24 is plugged inside the male socket 20, the conducting wires 200 are confined within the trenches 240 of the stopper 24 and the internal wall of the male socket 20.

Figure 10:
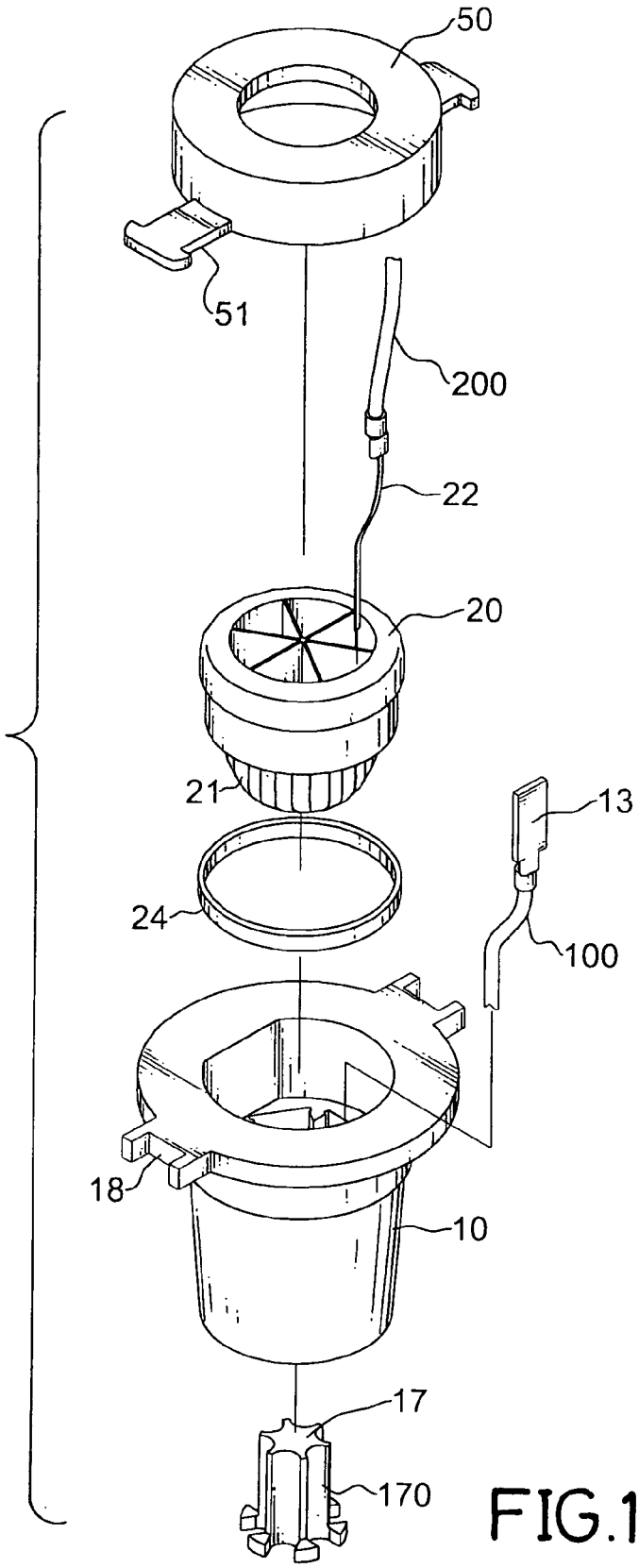
FIG. 10 shows an exploded perspective view of a third preferred embodiment of the present invention.
Figure 11:
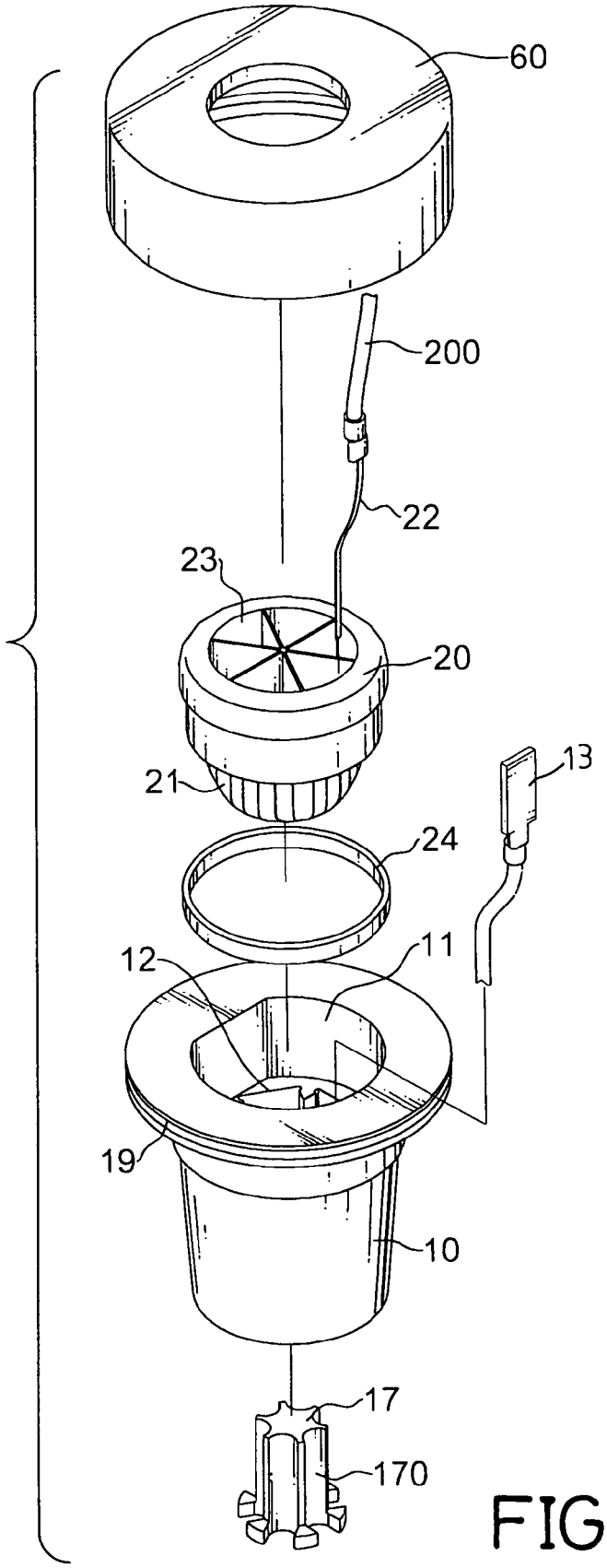
FIG. 11 shows an exploded perspective view of a fourth preferred embodiment of the present invention.

Referring to FIG. 10, a third preferred embodiment of the present invention is shown. The basic structure is similar to the first preferred embodiment, yet connection manners of the joint nut 50 and the female socket 10 are different. The third preferred embodiment includes the joint nut 50 having two opposite nut peripheries extending outward to form a 'T'-shaped buckle 51 respectively. Further, the two opposite locations on the top of the female socket 10 form open catches 18 respectively. When the joint nut 50 and the female socket 10 are mated, the buckles 51 on the joint nut 50 can be bent downward to make the wider end of each buckle 51 engage with a lower edge of the respective open catch 18. Thereby the third preferred embodiment of the present invention provides another connection manner for the joint nut 50 and the female socket 10.

In addition, the positions of the joint nut 50 and the female socket 10 of the third preferred embodiment of the present invention can be exchanged or any other similar buckle catches can replace the structure.

Referring to FIG. 1, a fourth preferred embodiment of the present invention has a basic structure similar to the first preferred embodiment, yet the connection manners of the joint nut 50 and the female socket 10 are different. The joint nut 60 forms an internal screw (not shown in the diagram), and the top of the female socket 10 forms an external screw 19. Thereby the joint nut 60 can be screwingly connected to the female socket 10.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A connector for connecting light strings comprising:

a female socket forming a cannular shape having multiple terminal receivers on an internal wall for receiving electric terminals respectively; wherein an aperture is formed on a bottom for paired light-string conducting wires or control lines to extend through the aperture;

a male socket forming a cylindrical shape with an end forming a cylindrical plug part; wherein an outside diameter of the plug part matches an inside diameter of the female socket to plug with the female socket; wherein multiple axial holes are defined on the male socket for the paired light-string conducting wires or control lines to extend through the axial holes; wherein multiple conductive pieces extend through the axial holes respectively, and an end of each conductive piece bends to a surface of the plug part, while the other end is connected to the conducting wires or the control lines inside the male socket; wherein the conductive pieces correspond to the electric terminals on the internal wall of the female socket; and a joint nut mounted outside the male socket and reciprocally joining with the female socket for confining the male socket located between the joint nut and the female socket, so that the male/female sockets will not separate unintentionally.

2. The connector as claimed in claim 1, wherein the female socket further comprises a waterproof stopper inside the bottom of the female socket for filling up vacant spaces between the aperture and the conducting wires.

3. The connector as claimed in claim 2, wherein the terminal receives are symmetrically arranged in the female socket; wherein multiple trenches are defined on the bottom of the female socket, each of the trenches corresponds to an under part of a respective terminal receiver, so as to make each conducting wire connect to an end of the terminal receiver located inside the trench; and the waterproof stopper forming a shaft shape with a profile forming multiple channels; wherein each of the channels corresponds to a respective trench of the female socket.

4. The connector as claimed in claim 3, wherein the joint nut forms a hole for the light-string conducting wires or control lines to extend through the joint nut; wherein a bore diameter of the hole is smaller than the outside diameter of the male socket, so as to limit the male socket that is located inside the joint nut.

5. The connector as claimed in claim 4, wherein the joint nut further comprises two tenon joints respectively extending from opposed sides of the joint nut; a top of the female socket forms a flange; two slots are defined at opposite locations of the flange, wherein one end of the slot is wider than the other end, and the wider end of each slot is to selectively receive a respective tenon joint.

6. The connector as claimed in claim 4, wherein the joint nut further comprises two buckle pieces extending downward from two opposite peripheries of the joint nut; wherein two buckle slots are oppositely defined on a top surface of the female socket to engage with the buckle pieces.

7. The connector as claimed in claim 4, wherein the joint nut forms an internal screw thread; wherein a top of the female socket forms an external screw thread for the internal screw thread to form a screw joint.

8. The connector as claimed in claim 2, wherein the joint nut forms a hole for the light-string conducting wires or control lines to extend through the joint nut; wherein a bore diameter of the hole is smaller than the outside diameter of the male socket, so as to limit the male socket that is located inside the joint nut.

9. The connector as claimed in claim 8, wherein the joint nut further comprises two tenon joints respectively extending from opposed sides of the joint nut; a top of the female socket forms a flange; two slots are defined at opposite locations of the flange, wherein one end of the slot is wider than the other end, and the wider end of each slot is to selectively receive a respective tenon joint.

10. The connector as claimed in claim 8, wherein the joint nut further comprises two buckle pieces extending downward from two opposite peripheries of the joint nut; wherein two buckle slots are oppositely defined on a top surface of the female socket to engage with the buckle pieces.

11. The connector as claimed in claim 8, wherein the joint nut forms an internal screw thread; wherein a top of the female socket forms an external screw thread for the internal screw thread to form a screw joint.

12. The connector as claimed in claim 1, wherein the male socket forms a hollow shape; wherein a plurality of radiant shaped partitions are formed inside the male socket, and each of the axial holes of the male socket is separated equally by the partitions.

13. The connector as claimed in claim 12, wherein a collar is mounted on a top of the plug part of the male socket, and the collar holds the conductive pieces that are bent to the bottom of the plug part.

14. The connector as claimed in claim 1, wherein the male socket forms a hollow shape and further comprises a stopper; wherein the stopper forms a column shape with a profile forming a plurality of trenches; wherein each of the trenches corresponds to the axial holes of the male socket respectively.

15. The connector as claimed in claim 14, wherein a collar is mounted on a top of the plug part of the male socket, and the collar holds the conductive pieces that are bent to the bottom of the plug part.

16. The connector as claimed in claim 1, wherein a collar is mounted on a top of the plug part of the male socket, and the collar holds the conductive pieces that are bent to the bottom of the plug part.

17. The connector as claimed in claim 1, wherein the joint nut forms a hole for the light-string conducting wires or control lines to extend through the joint nut; wherein a bore diameter of the hole is smaller than the outside diameter of the male socket, so as to limit the male socket that is located inside the joint nut.

18. The connector as claimed in claim 17, wherein the joint nut further comprises two tenon joints respectively extending from opposed sides of the joint nut; a top of the female socket forms a flange; two slots are defined at opposite locations of the flange, wherein one end of the slot is wider than the other end, and the wider end of each slot is to selectively receive a respective tenon joint.

19. The connector as claimed in claim 17, wherein the joint nut further comprises two buckle pieces extending downward from two opposite peripheries of the joint nut; wherein two buckle slots are oppositely defined on a top surface of the female socket to engage with the buckle pieces.

20. The connector as claimed in claim 17, wherein the joint nut forms an internal screw thread; wherein a top of the female socket forms an external screw thread for the internal screw thread to form a screw joint.

* * * * *